US011761671B2

(12) United States Patent
Tambakhe et al.

(10) Patent No.: US 11,761,671 B2
(45) Date of Patent: Sep. 19, 2023

(54) COMPACT DIFFUSER

(71) Applicant: Air Distribution Technologies IP, LLC, Milwaukee, WI (US)

(72) Inventors: Rahul Ashokrao Tambakhe, Amravati (IN); John M. Pinkston, Carrollton, TX (US)

(73) Assignee: AIR DISTRIBUTION TECHNOLOGIES IP, LLC, Milwaukee, WI (US)

( * ) Notice: Subject to any disclaimer, the term of this patent is extended or adjusted under 35 U.S.C. 154(b) by 614 days.

(21) Appl. No.: 16/703,545

(22) Filed: Dec. 4, 2019

(65) Prior Publication Data

US 2021/0172644 A1 Jun. 10, 2021

(51) Int. Cl.
*F24F 13/06* (2006.01)

(52) U.S. Cl.
CPC ..... *F24F 13/06* (2013.01); *F24F 2013/0608* (2013.01); *F24F 2013/0616* (2013.01)

(58) Field of Classification Search
USPC ..... 454/245
See application file for complete search history.

(56) References Cited

U.S. PATENT DOCUMENTS

| | | | | |
|---|---|---|---|---|
| 6,260,375 | B1 | 7/2001 | Kuo | |
| 6,287,191 | B1 * | 9/2001 | Barker, II | F24F 7/06 454/251 |
| 6,974,381 | B1 * | 12/2005 | Walker | F24F 7/007 454/230 |
| 8,911,286 | B1 | 12/2014 | Savigny | |
| 2013/0195715 | A1 * | 8/2013 | Warren | A61L 9/205 422/4 |
| 2017/0067659 | A1 * | 3/2017 | Silver | F24F 7/08 |

* cited by examiner

*Primary Examiner* — Vivek K Shirsat
(74) *Attorney, Agent, or Firm* — Fletcher Yoder, P.C.

(57) ABSTRACT

A diffuser assembly includes a housing that defines an internal chamber having an open end, a return air outlet, and a supply air inlet; a cover sized to cover the open end, wherein the cover defines a return air inlet and a supply air outlet; and an internal return air duct longitudinally extending within the internal chamber and connecting the return air inlet and the return air outlet, wherein the internal return air duct includes an inner duct surface that defines a return air chamber within the internal return air duct and an outer duct surface that defines a supply air chamber between the housing and the outer duct surface, wherein the supply air chamber defines a supply air path between the supply air inlet and the supply air outlet.

20 Claims, 6 Drawing Sheets

COMPACT DIFFUSER

BACKGROUND

The present disclosure relates generally to heating, ventilation, and air conditioning systems, and in particular, to a diffuser for use in a heating, ventilation, and air conditioning (HVAC) system.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

In an aspect, for example, a diffuser assembly includes a housing that defines an internal chamber having an open end, a return air outlet, and a supply air inlet; a cover sized to cover the open end, wherein the cover defines a return air inlet and a supply air outlet; and an internal return air duct longitudinally extending within the internal chamber and connecting the return air inlet and the return air outlet, wherein the internal return air duct includes an inner duct surface that defines a return air chamber within the internal return air duct and an outer duct surface that defines a supply air chamber between the housing and the outer duct surface, wherein the supply air chamber defines a supply air path between the supply air inlet and the supply air outlet.

In another aspect, a heating, ventilation, and air conditioning (HVAC) system includes an air handling unit and a diffuser assembly connected to the air handling unit via a supply air duct and a return air duct. The diffuser assembly includes a housing that defines an internal chamber having an open end, a return air outlet, and a supply air inlet; a cover sized to cover the open end, wherein the cover defines a return air inlet and a supply air outlet; and an internal return air duct longitudinally extending within the internal chamber and connecting the return air inlet and the return air outlet, wherein the internal return air duct includes an inner duct surface that defines a return air chamber within the internal return air duct and an outer duct surface that defines a supply air chamber between the housing and the outer duct surface, wherein the supply air chamber defines a supply air path between the supply air inlet and the supply air outlet.

In a further aspect, a diffuser assembly kit includes a housing that defines an internal chamber having an open end, a return air outlet, and a supply air inlet; a cover sized and engageable to cover the open end, wherein the cover defines a return air inlet and a supply air outlet; and an internal return air duct longitudinally extendable within the internal chamber and connectable to the return air inlet and the return air outlet, wherein the internal return air duct includes an inner duct surface that is positionable to define a return air chamber within the internal return air duct and an outer duct surface that is positionable to define a supply air chamber between the housing and the outer duct surface, wherein the supply air chamber defines a supply air path between the supply air inlet and the supply air outlet.

To the accomplishment of the foregoing and related ends, the one or more aspects comprise the features hereinafter fully described and particularly pointed out in the claims. The following description and the annexed drawings set forth in detail certain illustrative features of the one or more aspects. These features are indicative, however, of but a few of the various ways in which the principles of various aspects may be employed, and this description is intended to include all such aspects and their equivalents.

BRIEF DESCRIPTION OF THE DRAWINGS

The disclosed aspects will hereinafter be described in conjunction with the appended drawings, provided to illustrate and not to limit the disclosed aspects, wherein like designations denote like elements, and in which.

DETAILED DESCRIPTION

Figure 2:
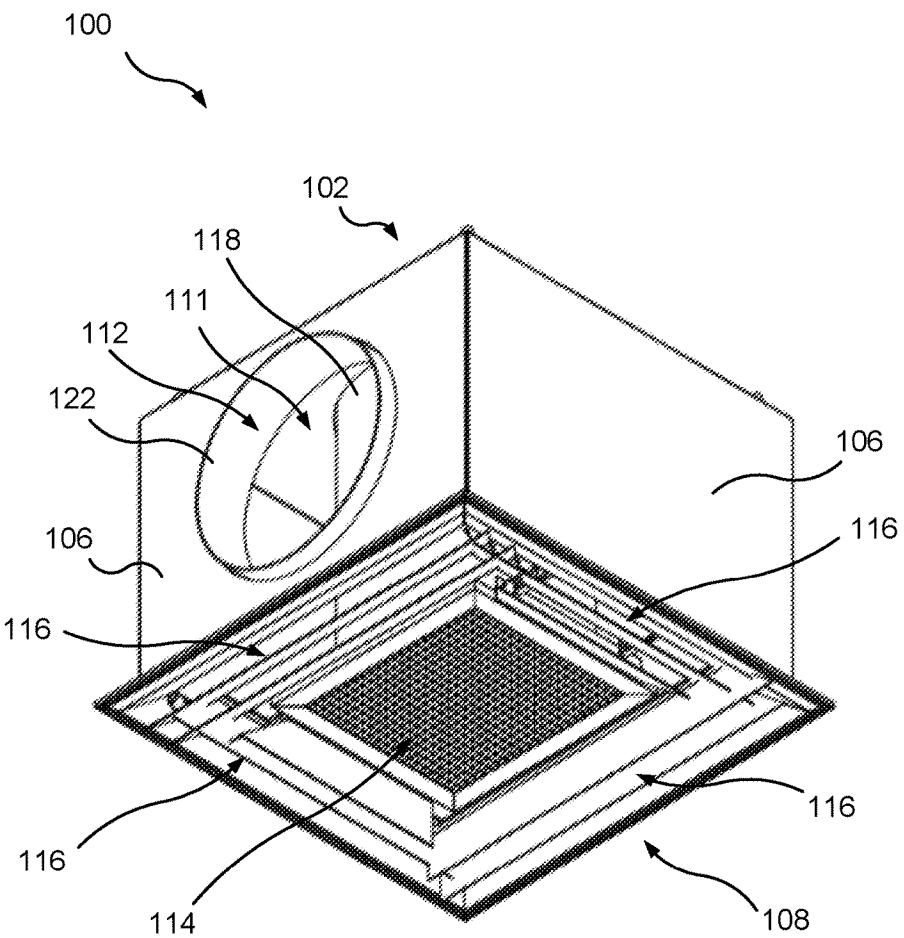
FIG. 2 is an isometric bottom left view of the example diffuser assembly of FIG. 1.
Figure 1:
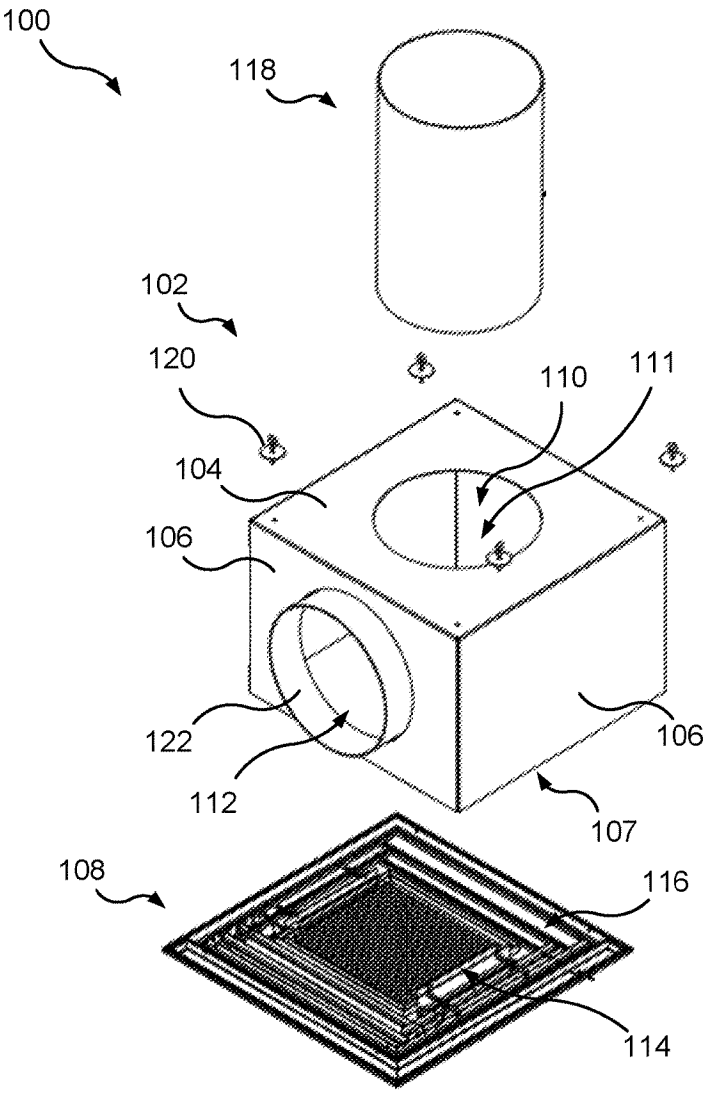
FIG. 1 is an exploded top left isometric view of an example diffuser assembly according to the present aspects.

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known components may be shown in block diagram form in order to avoid obscuring such concepts.

Aspects of the present disclosure provide a diffuser assembly including a housing that defines openings to and from an internal chamber to define a supply air path, and a internal return air duct that extends from one side of the housing to an opposing side, across the internal chamber, to define a direct return air path. In an implementation, for example, the housing includes at least a first wall connected to one or more adjacent walls to define the internal chamber, which has an open end opposite the first wall. The diffuser assembly may additionally include a cover member configured to fit on the open end and enclose the internal chamber. The cover member includes at least one first internal grill wall that defines a return air inlet, and the first wall includes an internal wall that defines a corresponding return air outlet. The internal return air duct is connected to and extends between the opposing return air inlet and the return air outlet. In some configuration, the return air inlet and the return air outlet are aligned on opposing sides of the diffuser assembly, thereby defining a direct or substantially straight return air path via the internal return air duct extending through the diffuser assembly. The one or more adjacent walls of the housing may include an internal wall that defines a supply air inlet that is in communication via the internal chamber with one or more supply air outlets defined by one or more second internal grill walls of the cover member. In some configurations, the arrangement of the supply air inlet and the one or more supply air outlets define a curved supply air path through the diffuser assembly. In some cases, the internal return air duct may be concentrically positioned within the diffuser assembly to provide a single-point air distribution system having unobstructed supply and return air flows. Thus, in an aspect, the diffuser assembly according to the configurations described herein provides a simple and efficient air diffuser, as compared to prior solutions, by having a reduced number of parts, and hence reduced manufacturing cost, and by having improved airflow paths, thereby increasing airflow efficiency and heating, ventilation, and air conditioning (HVAC) system performance.

In some implementations, the walls of the diffuser assembly (e.g., the walls defining the internal chamber) may be formed in a variety of shapes, such as a rectangle, a square, a circle, etc.

In some implementations, the internal return air duct may be configured concentrically within the housing.

Referring to FIGS. 1-8 (which provide various views of an example aspect), in one non-limiting implementation, a diffuser assembly 100 has a housing 102 (also referred to as a diffuser box) with a first wall 104 connected to a set of one or more adjacent walls (e.g., a second wall 106, etc.) to define an internal chamber 111 having an open end 107, where the first wall 104 defines a closed end of the housing 102 opposite the open end 107 and extending substantially in a plane parallel to the open end 107. The first wall 104 includes a first internal surface that defines a return air outlet 110, and the second wall 106 has a second internal surface that defines a supply air inlet 112. The diffuser assembly 100 further includes a cover member 108 having a cover body sized to cover the open end 107 and connect to the set of one or more adjacent walls (e.g., the second wall 106). The cover body of the cover member 108 includes a first internal grill wall defining a return air inlet 114 and a second internal grill wall defining a plurality of supply air outlets 116 surrounding the return air inlet 114. The first wall 104 and the cover member 108 extend substantially in parallel to each other, and the second wall 106 is adjoining with and extends substantially orthogonal to both the first wall 104 and the cover member 108.

Figures 3, 4, 5:
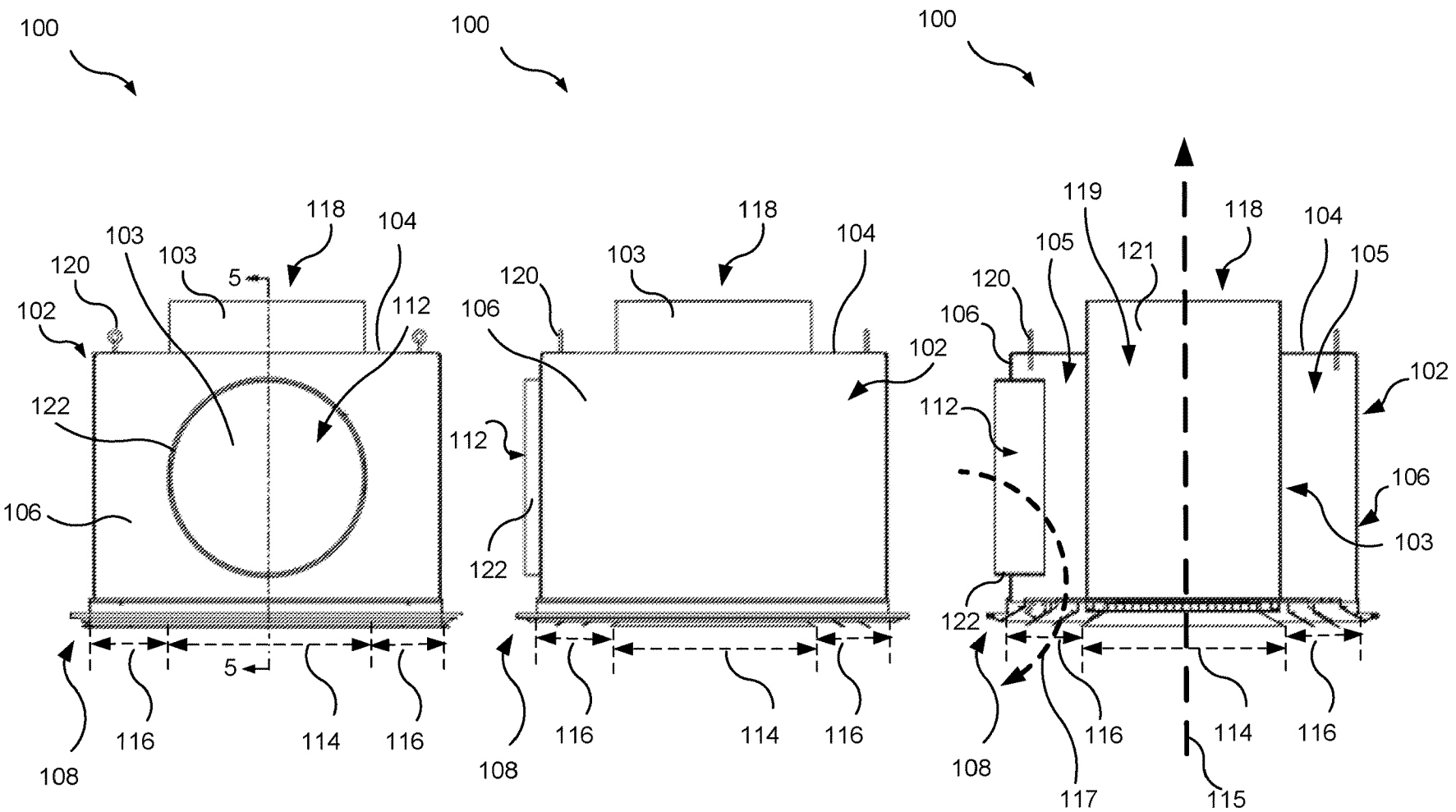
FIG. 3 is a left side view of the example diffuser assembly of FIG. 1.
FIG. 4 is a front side view of the example diffuser assembly of FIG. 1.
FIG. 5 is a cross-sectional view of the example diffuser assembly of FIG. 1 along line 5-5 in FIG. 3.
Figure 6:
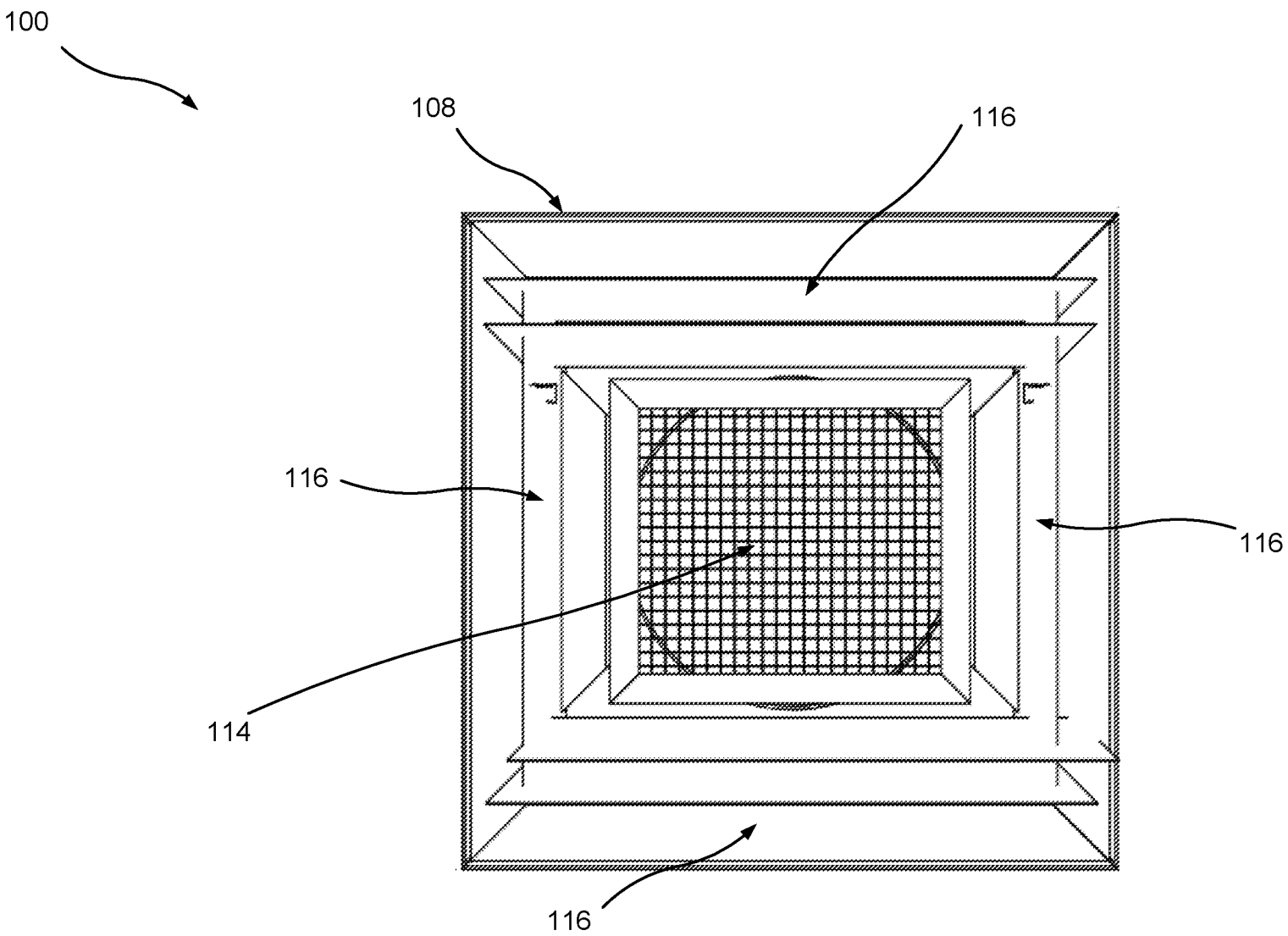
FIG. 6 is a bottom view of the example diffuser assembly of FIG. 1.
Figure 8:
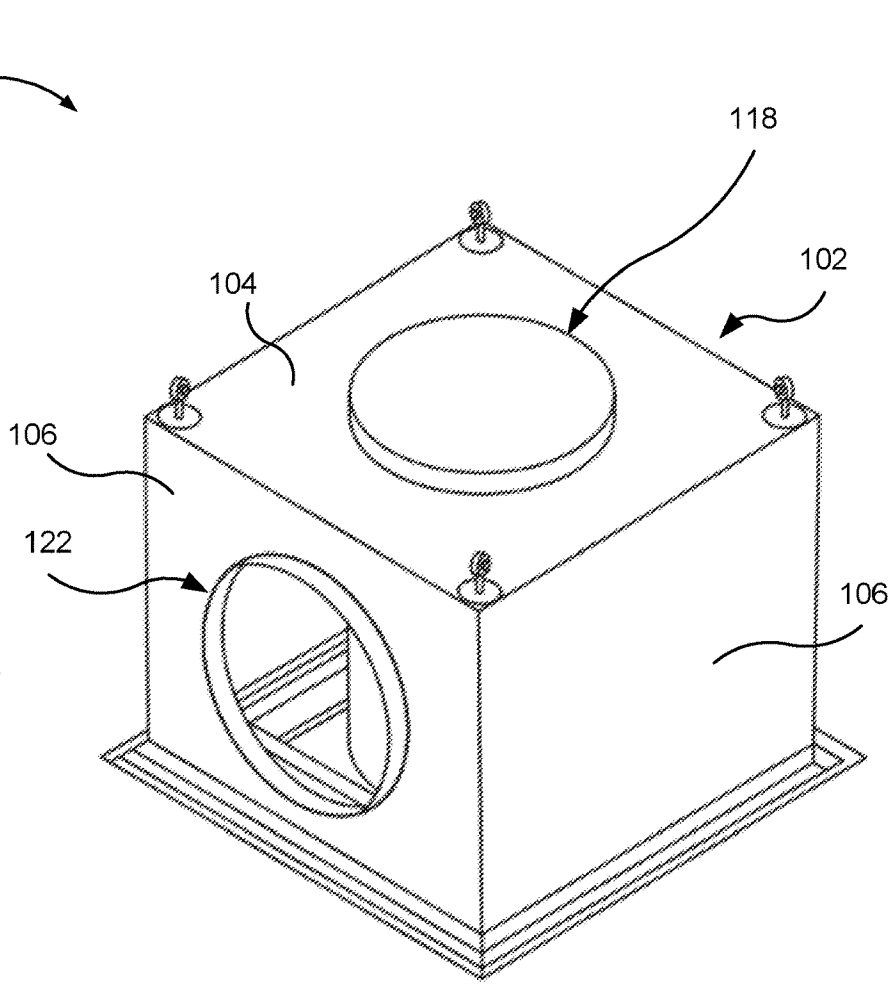
FIG. 8 is a top left isometric view of the example diffuser assembly of FIG. 1.
Figure 7:
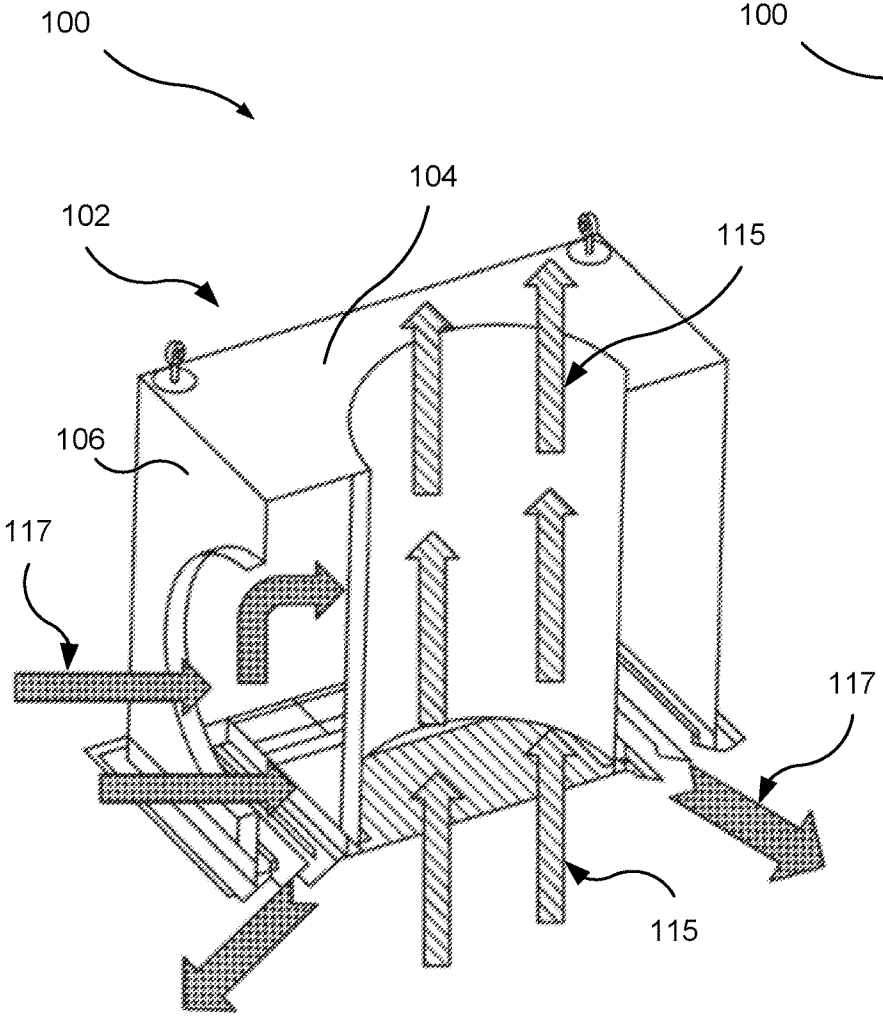
FIG. 7 is a cross-sectional top left isometric view of the example diffuser assembly of FIG. 1 along line 5-5 in FIG. 3.

The diffuser assembly further includes an internal return air duct 118 having a duct wall longitudinally extending within the internal chamber 111 and connecting the return air outlet 110 with the return air inlet 114, thereby defining an unobstructed and substantially straight return air path 115 (FIG. 5). The duct wall of the internal return air duct 118 includes an inner duct surface 121 that defines a return air chamber 119 within the internal return air duct 118 and an outer duct surface 103 that defines a supply air chamber 105 between the housing 102 and the outer duct surface 103, where the supply air chamber 105 defines a supply air path 117 (FIG. 5) between the supply air inlet 112 and the supply air outlets 116.

In an aspect, for example, the supply air outlets 116 may include one supply air outlet on each side of a rectangular return air inlet 114. Accordingly, in this aspect, the diffuser assembly 100 provides a four way supply air diffuser surrounding a center return air diffuser.

In an aspect, for example, the diffuser assembly 100 may be used with a T-bar ceiling or a plaster ceiling. For example, in an aspect, one or more fasteners 120 may be used to secure the diffuser assembly 100 to a T-bar or plaster ceiling.

In an aspect, for example, the diffuser assembly 100 may further include a collar 122 attachable to the supply air inlet 112 to facilitate attachment of a supply air duct (not shown) to the diffuser assembly 100.

In an aspect, the first wall 104 and the cover member 108 extend in substantially parallel planes and the return air inlet 114 is aligned with the return air outlet 110 such that the internal return air duct 118 defines an unobstructed and substantially straight return air path 115 (FIG. 5) between the return air inlet 114 and the return air outlet 110.

In an aspect, the second wall 106 is positioned substantially perpendicular to the cover body of the cover member 108 such that the supply air path 117 (FIG. 5) has a first direction at the supply air inlet 112 that is substantially perpendicular to a second direction at the supply air outlet 116. In an aspect, the supply air path 117 (FIG. 5) is unobstructed within the supply air chamber 105.

In an aspect, the internal return air duct 118 is concentrically positioned within the housing 102. In an aspect, for example, the internal return air duct 118 may have a circular cross-section along a plane orthogonal to the return air path 115 (FIG. 5) defined by the internal return air duct 118. In this case, the return air outlet 110 may also be circular. Alternatively, for example, in an aspect, the internal return air duct 118 may have a rectangular or square cross-section along a plane orthogonal to the return air path 115 (FIG. 5) defined by the internal return air duct 118. In this case, the return air outlet 110 may also be rectangular or square.

In an aspect, the housing 102 and/or the internal return air duct 118 may be manufactured using sheet metal, fiberglass, or any other similar material.

As such, the present aspects provide an efficient and compact concentric diffuser assembly providing supply and return air in a single unit.

As compared to conventional concentric diffusers, the concentric diffusers according to the present aspects provide improved airflow pattern since the supply and return air flows are unobstructed and the return air flow path is substantially straight. Therefore, the concentric diffusers according to the present aspects have a smaller overall size for the same airflow performance and pressure drop as conventional concentric diffusers.

Figure 9:
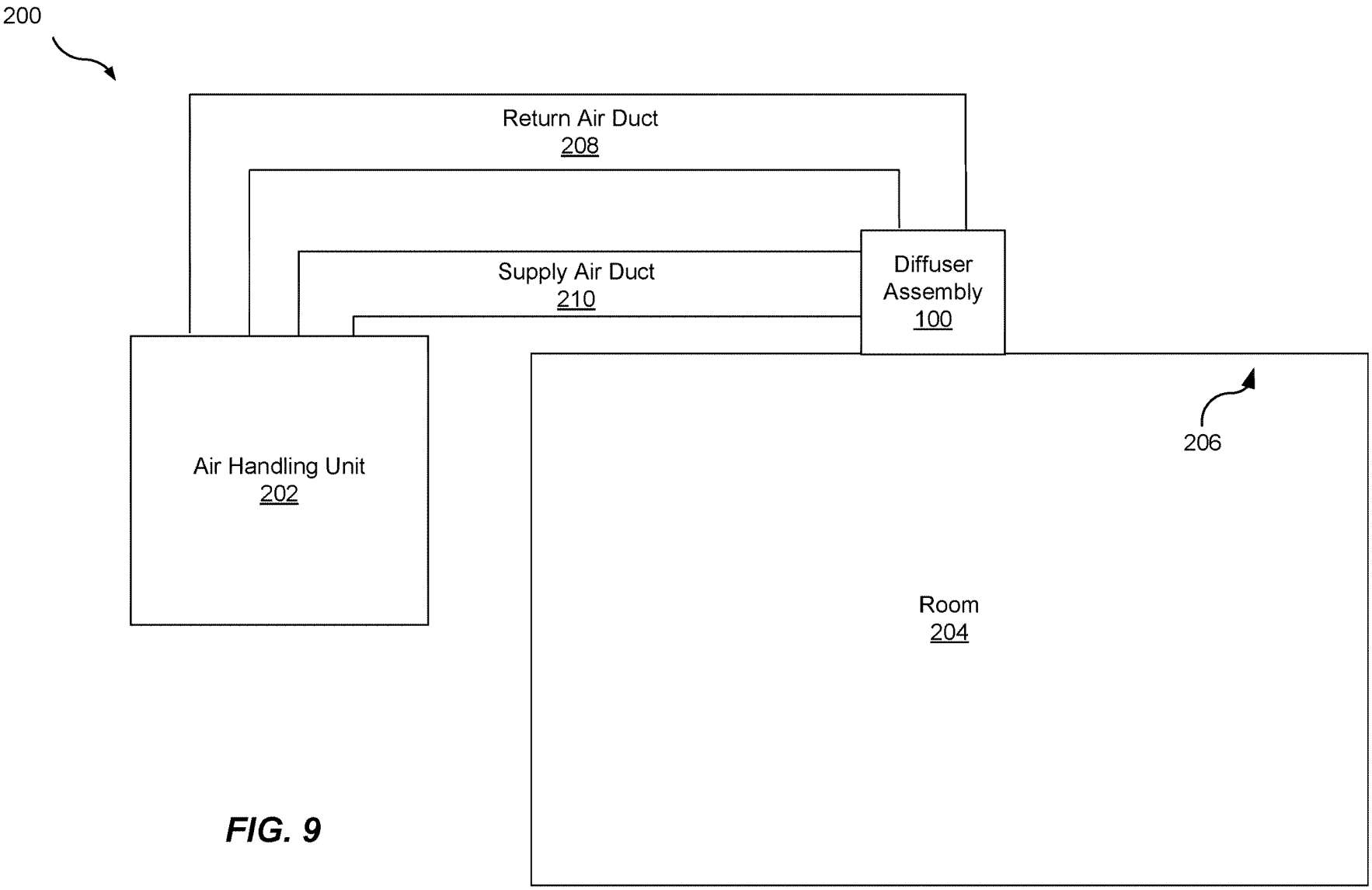
FIG. 9 is a block diagram of an example heating, ventilation, and air conditioning (HVAC) system including the example diffuser assembly of FIG. 1.
Figure 10:
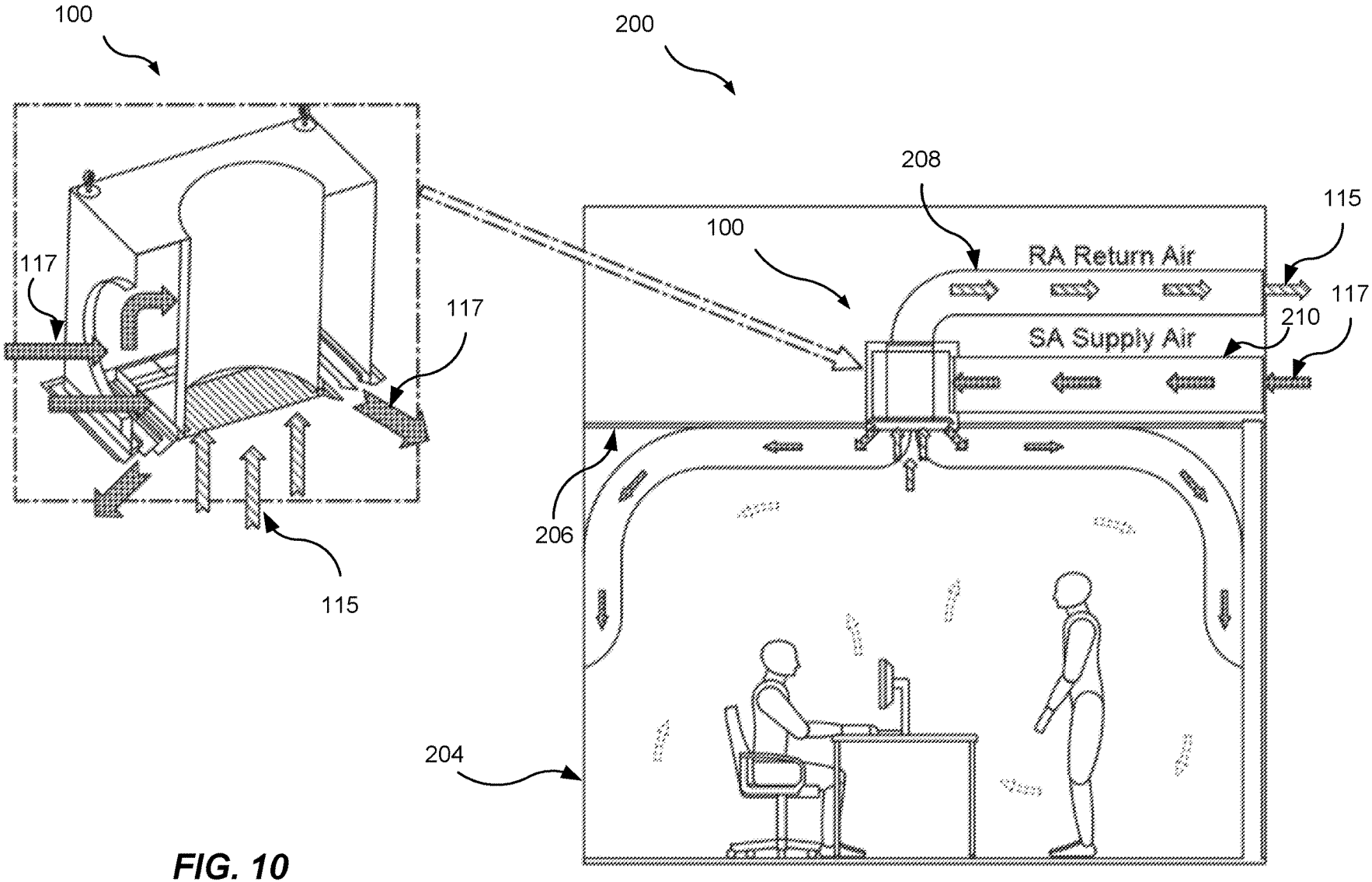
FIG. 10 is an example schematic diagram of air flow during an operation of the example diffuser assembly of FIG. 1.

Referring to FIGS. 9 and 10, in one non-limiting example aspect, an HVAC system 200 includes an air handling unit 202 (FIG. 9) that controls an ambient condition of a room 204 via fluid communication with a diffuser assembly 100 installed on a ceiling 206 of the room 204. The air handling unit 202 (FIG. 9) may include various components that facilitate HVAC functionality, such as an air conditioning (A/C) unit, a furnace, a blower, a humidifier, a dehumidifier, a heat pump, or any other components for adjusting an ambient condition of the room 204. The air handling unit 202 is coupled with the diffuser assembly 100 via a supply air duct 210 that provides supply air to the room 204 via the diffuser assembly 100, and a return air duct 208 that returns air from the room 204 via the diffuser assembly 100.

As compared to conventional diffusers, the diffusers according to the present aspects provide improved airflow pattern since the supply and return air flows are unobstructed and the return air flow path is substantially straight. Therefore, the diffusers according to the present aspects have a smaller overall size for the same airflow performance and pressure drop as conventional diffusers.

Further, as compared to conventional diffusers with a molded core, the diffusers according to the present aspects have a smaller overall size for the same airflow performance and pressure drop. As such, the diffusers according to the present aspects require less material, parts, and unit packing space for the same airflow performance and pressure drop as conventional diffusers with a molded core. For example, in an aspect, as compared to conventional diffusers with a molded core, the diffusers according to the present aspects may require 15-20% less material due to unit size reduction. Further, as compared to conventional diffusers with a molded core, the diffusers according to the present aspects require less assembly time.

Additionally, as compared to conventional diffusers with a molded core, the diffusers according to the present aspects may be manufactured with sheet metal and/or fiberglass duct board, thus requiring less process time. For example, in an aspect, as compared to conventional diffusers with a molded core, the manufacturing and assembly time may be reduced by 30% for the diffusers according to the present aspects. Further, the diffusers according to the present aspects do not require the molded core tooling.

As disclosed, the present aspects provide a diffuser assembly including a housing that defines an internal chamber having an open end, a return air outlet, and a supply air inlet; a cover sized to cover the open end, wherein the cover defines a return air inlet and a supply air outlet; and an internal return air duct longitudinally extending within the internal chamber and connecting the return air inlet and the return air outlet, wherein the internal return air duct includes an inner duct surface that defines a return air chamber within the internal return air duct and an outer duct surface that defines a supply air chamber between the housing and the outer duct surface, wherein the supply air chamber defines a supply air path between the supply air inlet and the supply air outlet.

Optionally, the housing includes a closed end opposite the open end, wherein the closed end and the cover extend in substantially parallel planes, and wherein the return air inlet is aligned with the return air outlet such that the internal return air duct defines an unobstructed and substantially straight return air path between the return air inlet and the return air outlet.

Optionally, the housing includes a first wall connected to a set of one or more adjacent walls to define the internal chamber, wherein the first wall includes a first internal surface that defines the return air outlet, wherein the set of one or more adjacent walls includes a second internal surface that defines the supply air inlet; and the cover includes a first internal grill wall and a second internal grill wall, wherein the first internal grill wall defines the return air inlet, and wherein the second internal grill wall defines the supply air outlet Optionally, the first wall and the cover extend in substantially parallel planes.

Optionally, the set of one or more adjacent walls are positioned substantially perpendicular to the cover such that the supply air path has a first direction at the supply air inlet that is substantially perpendicular to a second direction at the supply air outlet.

Optionally, the supply air path is unobstructed within the supply air chamber.

Optionally, the internal return air duct is concentrically positioned within the housing.

Optionally, the internal return air duct has a circular cross-section along a plane orthogonal to a return air path defined by the internal return air duct.

Optionally, the return air outlet is circular.

Optionally, the internal return air duct has a rectangular or square cross-section along a plane orthogonal to a return air path defined by the internal return air duct.

Optionally, the return air outlet is rectangular or square.

Optionally, at least one of the housing or the internal return air duct comprises a sheet metal material.

Optionally, at least one of the housing or the internal return air duct comprises a fiberglass material.

In another aspect, a heating, ventilation, and air conditioning (HVAC) system is provided that includes an air handling unit and a diffuser assembly connected to the air handling unit via a supply air duct and a return air duct. The diffuser assembly includes a housing that defines an internal chamber having an open end, a return air outlet, and a supply air inlet; a cover sized to cover the open end, wherein the cover defines a return air inlet and a supply air outlet; and an internal return air duct longitudinally extending within the internal chamber and connecting the return air inlet and the return air outlet, wherein the internal return air duct includes an inner duct surface that defines a return air chamber within the internal return air duct and an outer duct surface that defines a supply air chamber between the housing and the outer duct surface, wherein the supply air chamber defines a supply air path between the supply air inlet and the supply air outlet.

In a further aspect, a diffuser assembly kit is provided that includes a housing that defines an internal chamber having an open end, a return air outlet, and a supply air inlet; a cover sized and engageable to cover the open end, wherein the cover defines a return air inlet and a supply air outlet; and an internal return air duct longitudinally extendable within the internal chamber and connectable to the return air inlet and the return air outlet, wherein the internal return air duct includes an inner duct surface that is positionable to define a return air chamber within the internal return air duct and an outer duct surface that is positionable to define a supply air chamber between the housing and the outer duct surface, wherein the supply air chamber defines a supply air path between the supply air inlet and the supply air outlet.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more. Combinations such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, where any such combinations may contain one or more member or members of A, B, or C. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. The words "module," "mechanism," "element," "device," and the like may not be a substitute for the word "means." As such, no claim element is to be construed as a means plus function unless the element is expressly recited using the phrase "means for."

What is claimed is:

1. A diffuser assembly, comprising:

a housing comprising a first wall and a plurality of second walls extending from the first wall to define an internal chamber of the housing, wherein the first wall comprises a return air outlet formed therein, each second wall of the plurality of second walls is exposed to the internal chamber and defines an outer boundary of the housing, a second wall of the plurality of second walls comprises a supply air inlet formed therein, and the internal chamber comprises an open end;

a cover sized to cover the open end, wherein the cover defines a return air inlet and a supply air outlet; and an internal return air duct longitudinally extending within the internal chamber to define a substantially straight return air flow path from the return air inlet to the return air outlet, wherein the internal return air duct includes an inner duct surface that defines the substantially straight return air flow path and includes an outer duct surface that defines a supply air chamber between the first wall, the plurality of second walls, and the outer duct surface, wherein the supply air chamber defines a supply air flow path between the supply air inlet and the supply air outlet, wherein the internal return air duct comprises an opening to discharge return air from the internal return air duct via the substantially straight return air flow path, and wherein a first central axis of a first cross-section of the opening of the internal return air duct is aligned with a second central axis of a second cross-section of the return air outlet formed in the first wall.

2. The diffuser assembly of claim 1, wherein the housing includes a closed end opposite the open end, and wherein the closed end and the cover extend in substantially parallel planes.

3. The diffuser assembly of claim 1, wherein the cover includes a first internal grill wall and a second internal grill wall, wherein the first internal grill wall defines the return air inlet, and wherein the second internal grill wall defines the supply air outlet.

4. The diffuser assembly of claim 1, wherein the first wall and the cover extend in substantially parallel planes.

5. The diffuser assembly of claim 1, wherein the second wall of the plurality of second walls is positioned substantially perpendicular to the cover such that the supply air flow path has a first direction at the supply air inlet that is substantially perpendicular to a second direction at the supply air outlet.

6. The diffuser assembly of claim 1, wherein the supply air flow path is unobstructed within the supply air chamber.

7. The diffuser assembly of claim 1, wherein the internal return air duct is concentrically positioned within the housing.

8. The diffuser assembly of claim 1, wherein the internal return air duct has a circular cross-section along a plane orthogonal to the substantially straight return air flow path defined by the internal return air duct.

9. The diffuser assembly of claim 8, wherein the return air outlet is circular.

10. The diffuser assembly of claim 1, wherein at least one of the housing or the internal return air duct comprises a sheet metal material or a fiberglass material.

11. A heating, ventilation, and air conditioning (HVAC) system, comprising:

an air handling unit; and a diffuser assembly connected to the air handling unit via a supply air duct and a return air duct, wherein the diffuser assembly comprises:

a housing comprising a first wall and a plurality of second walls extending from the first wall to define an internal chamber of the housing, wherein the plurality of second walls extends from the internal chamber to an outer boundary of the housing, the first wall comprises a return air outlet formed therein, a second wall of the plurality of second walls comprises a supply air inlet formed therein, and the internal chamber comprises an open end;

a cover sized to cover the open end, wherein the cover defines a return air inlet and a supply air outlet; and an internal return air duct longitudinally extending within the internal chamber to define a substantially straight return air flow path from the return air inlet to the return air outlet, wherein the internal return air duct includes an inner duct surface that defines the substantially straight return air flow path and includes an outer duct surface that defines a supply air chamber between the first wall, the plurality of second walls, and the outer duct surface, wherein the supply air chamber defines a supply air flow path between the supply air inlet and the supply air outlet, wherein each second wall of the plurality of second walls comprises a first surface that is exposed to the internal chamber and a second surface that defines the outer boundary of the housing, and wherein the cover abuts the second surface of each second wall of the plurality of second walls.

12. The HVAC system of claim 11, wherein the cover includes a first internal grill wall and a second internal grill wall, wherein the first internal grill wall defines the return air inlet, and wherein the second internal grill wall defines the supply air outlet.

13. The HVAC system of claim 11, wherein the first wall and the cover extend in substantially parallel planes.

14. The HVAC system of claim 11, wherein the second wall of the plurality of second walls is positioned substantially perpendicular to the cover such that the supply air flow path has a first direction at the supply air inlet that is substantially perpendicular to a second direction at the supply air outlet.

15. The HVAC system of claim 11, wherein the supply air flow path is unobstructed within the supply air chamber.

16. The HVAC system of claim 11, wherein the internal return air duct is concentrically positioned within the housing.

17. The HVAC system of claim 11, wherein the internal return air duct has a circular cross-section along a plane orthogonal to the substantially straight return air flow path defined by the internal return air duct, and wherein the return air outlet is circular.

18. The HVAC system of claim 11, wherein at least one of the housing or the internal return air duct comprises a sheet metal material or a fiberglass material.

19. The HVAC system of claim 11, wherein the second surface faces away from the first surface and is exposed to an environment exterior to the internal chamber.

20. A diffuser assembly kit, comprising:

a housing comprising a first wall and a plurality of second walls extending from the first wall to define an internal chamber of the housing, wherein the first wall comprises a return air outlet formed therein, a second wall of the plurality of second walls comprises a supply air inlet formed therein, and the internal chamber comprises an open end;

a cover sized and engageable to cover the open end, wherein the cover defines a return air inlet and a supply air outlet; and an internal return air duct longitudinally extendable within the internal chamber to define a substantially straight return air flow path from the return air inlet to the return air outlet, wherein the internal return air duct includes an inner duct surface that is positionable to define the substantially straight return air flow path and includes an outer duct surface that is positionable to define a supply air chamber between the first wall, the plurality of second walls, and the outer duct surface, wherein the supply air chamber defines a supply air flow path between the supply air inlet and the supply air outlet, and the first wall of the housing encompasses and abuts the outer duct surface of the internal return air duct about an entire perimeter of the outer duct surface.

* * * * *